US007498994B2

(12) United States Patent
Vacanti

(10) Patent No.: US 7,498,994 B2
(45) Date of Patent: Mar. 3, 2009

(54) DUAL BAND ANTENNA APERATURE FOR MILLIMETER WAVE SYNTHETIC VISION SYSTEMS

(75) Inventor: David C. Vacanti, Renton, WA (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 11/535,163

(22) Filed: Sep. 26, 2006

(65) Prior Publication Data

US 2008/0074338 A1 Mar. 27, 2008

(51) Int. Cl.
*H01Q 21/00* (2006.01)
*H01Q 13/10* (2006.01)

(52) U.S. Cl. ..... 343/725; 343/770; 343/771; 343/700 MS

(58) Field of Classification Search ..... 343/725, 343/700 MS, 770, 771
See application file for complete search history.

(56) References Cited

U.S. PATENT DOCUMENTS

| | | | | |
|---|---|---|---|---|
| 3,771,158 | A | 11/1973 | Hatcher | |
| 4,675,681 | A * | 6/1987 | Kinsey | 342/372 |
| 4,700,193 | A * | 10/1987 | Sa et al. | 342/427 |
| 4,755,821 | A * | 7/1988 | Itoh et al. | 343/700 MS |
| 5,394,163 | A | 2/1995 | Bullen et al. | |
| 5,661,493 | A * | 8/1997 | Uher et al. | 343/700 MS |
| 6,166,701 | A | 12/2000 | Park et al. | |
| 2002/0050946 | A1 * | 5/2002 | Chang et al. | 342/368 |
| 2003/0071753 | A1 | 4/2003 | Vacanti | |

FOREIGN PATENT DOCUMENTS

| | | |
|---|---|---|
| EP | 0188345 | 7/1986 |
| EP | 0209156 | 1/1987 |
| EP | 0747994 | 12/1996 |
| EP | 0825671 | 2/1998 |
| FR | 2734411 | 11/1996 |

OTHER PUBLICATIONS

Malibu Research, "Introduction to FLAPS", Oct. 26, 2007, pp. 1-10, Publisher: http://www.maliburesearch.com/technology.htm, Published in: US.
European Patent Office, "European Search Report", Apr. 8, 2008, Published in: EP.

* cited by examiner

*Primary Examiner*—Hoang V Nguyen
(74) *Attorney, Agent, or Firm*—Fogg & Powers LLC

(57) ABSTRACT

A dual band antenna system for synthetic vision systems including a slotted waveguide antenna having rows of slots on a front surface, a microstrip patch array antenna overlying the front surface of the slotted waveguide antenna; and at least one transceiver communicatively coupled to at least one of the slotted waveguide antenna and the microstrip patch array antenna.

20 Claims, 10 Drawing Sheets

DUAL BAND ANTENNA APERATURE FOR MILLIMETER WAVE SYNTHETIC VISION SYSTEMS

BACKGROUND

Aircraft include a weather antenna, such as an X-band slotted waveguide antenna, that is used during take off and landing to predict the presence of windshear in front of the aircraft. The X-band slotted waveguide antenna emits radiation into a relatively large azimuthal angle.

Millimeter wave (MMW) synthetic or enhanced vision systems for civil aviation are effective systems to provide visibility of objects located in fog, smoke, dust and other obscurants. Such synthetic vision systems would be useful if implemented to assist aircraft as it lands in areas that are foggy, smoky, dusty, or otherwise obscured. The millimeter wave antenna is generated by a microstrip antenna and emits radiation into a narrow beam azimuth angle that is appropriate for viewing the landing strip from a distance during take off and landing of an aircraft.

There is not enough available space within the radome of a civil transport or regional aircraft to scan a MMW antenna and to scan an X-band weather antenna. Thus, aircraft cannot simultaneously view the landing strip through obscurants and detect windshear in front of the plane.

Additionally, the cost of adding an additional antenna system to an aircraft makes an implementation of both an X-band slotted waveguide antenna and a dedicated MMW scanning antenna unlikely. The additional weight from a second antenna system reduces fuel efficiency of the aircraft and the range of the aircraft.

Even if room were available in the radome for both a MMW antenna and an X-band antenna, the signals emitted from the two antennae are likely to interfere with each other due to the two antenna structures interfering with the radiation pattern of the other antenna as they scan asynchronously.

SUMMARY

A first aspect of the present invention includes a dual band antenna system for synthetic vision systems including a slotted waveguide antenna having rows of slots on a front surface, a microstrip patch array antenna overlying the front surface of the slotted waveguide antenna; and at least one transceiver communicatively coupled to at least one of the slotted waveguide antenna and the microstrip patch array antenna.

DRAWINGS

In accordance with common practice, the various described features are not drawn to scale but are drawn to emphasize features relevant to the present invention. Reference characters denote like elements throughout figures and text.

DETAILED DESCRIPTION

In the following detailed description, reference is made to the accompanying drawings that form a part hereof, and in which is shown by way of illustration specific illustrative embodiments in which the invention may be practiced. These embodiments are described in sufficient detail to enable those skilled in the art to practice the invention, and it is to be understood that other embodiments may be utilized and that logical, mechanical and electrical changes may be made without departing from the scope of the present invention. The following detailed description is, therefore, not to be taken in a limiting sense.

Figure 1:
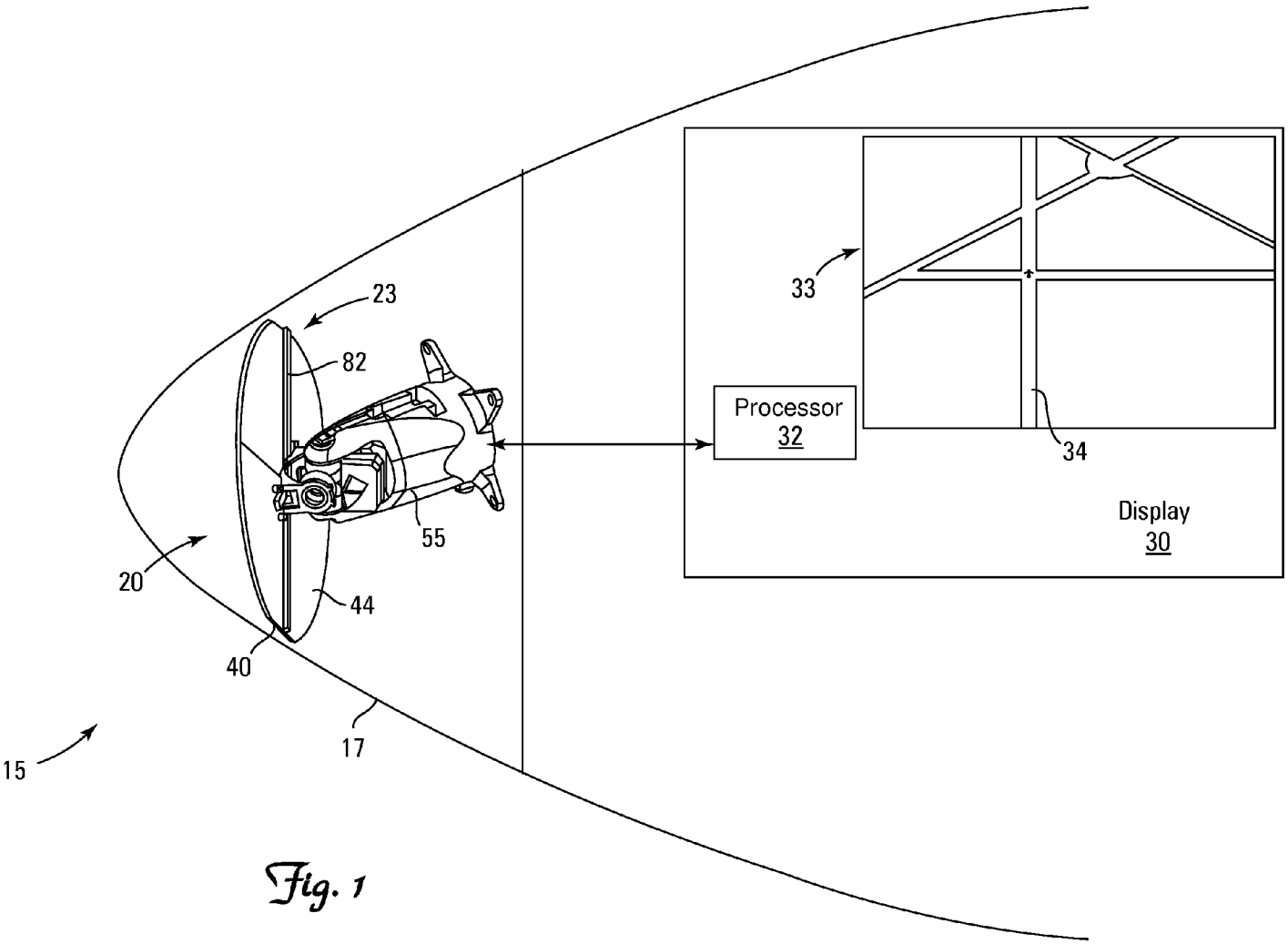
FIG. 1 shows one embodiment of a dual band antenna system for synthetic vision systems in a radome of an aircraft in accordance with the present invention.

FIG. 1 shows one embodiment of a dual band antenna system for synthetic vision systems 20 in a radome 17 of an aircraft 15 in accordance with the present invention. The shown radome 17 is at the front or "nose" of the aircraft 15. Only a front section 16 of the aircraft 15 is shown in FIG. 1. The dual band antenna system for synthetic vision systems 20, also referred to here as "dual band antenna system 20," includes a dual band antenna represented generally by the numeral 23 that is fed by at least one transceiver (not visible in FIG. 1) and mounted on at least one rotational stage (not visible in FIG. 1) in the pedestal 55. The dual band antenna 23, also referred to herein as "source 23," includes a slotted waveguide antenna 40 and a microstrip patch array antenna (not visible in FIG. 1). The slotted waveguide antenna 40 sends and receives signals via a slotted waveguide feedline 82.

The dual band antenna system 20 is communicatively coupled to display 30. The display 30 includes a processor 32 and a screen 33, which displays an image of a runway represented generally by the numeral 34.

The dual band antenna system 20 generates signals that provide information indicative of the images of the runway 34. The processor 32 receives the signals from the dual band antenna system 20 and processes the signals in order to display the image of the runway 34 on the screen 33 for viewing by a user of the aircraft 15.

Figure 2:
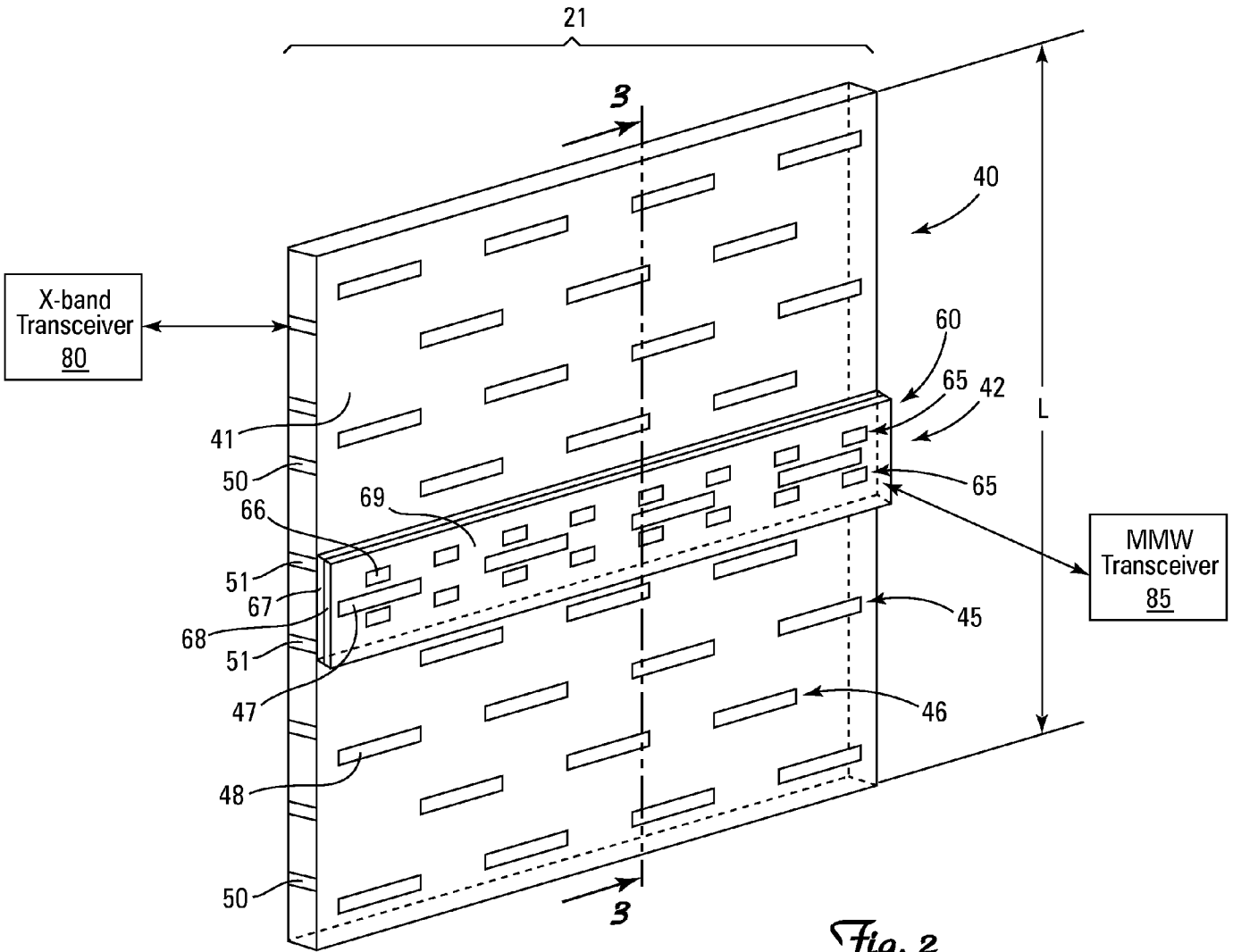
FIG. 2 shows an oblique view of one embodiment of a dual band antenna and communicatively coupled transceivers in accordance with the present invention.

FIG. 2 shows an oblique view of one embodiment of a dual band antenna 21 and communicatively coupled transceivers 80 and 85 in accordance with the present invention. The dual band antenna 21 is also referred to herein as "source 21." The microstrip patch array antenna represented generally by the numeral 60 overlays the front surface 41 of the slotted waveguide antenna represented generally by the numeral 40.

The millimeter wave (MMW) transceiver 85 is communicatively coupled to the microstrip patch array antenna 60. The X-band transceiver 80 is communicatively coupled to the slotted waveguide antenna 40.

The slotted waveguide antenna 40 has a width W and a length L. In one implementation of this embodiment, the width W of the slotted waveguide antenna 40 varies along the length L. For example, the edge of slotted waveguide antenna 40 is approximately circular as shown in FIG. 1. The slotted waveguide antenna 40 has rows of slots represented generally by the numerals 42, 45, and 46. The rows of slots 42, 45, and 46 extend parallel to the width edge along the width W of the slotted waveguide antenna 40. The walls 50 and/or 51 that are visible along the length edge of the slotted waveguide antenna 40 form cavities that extend under the rows of slots 42, 45, and 46.

As shown in the exemplary slotted waveguide antenna 40 of FIG. 2, the rows of slots 45 have four slots represented generally by the numeral 48 on a front surface 41. The rows of slots 46 alternate with the rows of slots 45 and have three slots 48 on the front surface 41. The single row of slots 42 has four slots represented generally by the numeral 47 on the front surface 41 that lie under the microstrip patch array antenna 60 and that alternate with the rows of slots 46. The row of slots 42 in the slotted waveguide antenna 40 is also referred to herein as "subset 42" of the rows of slots 42, 45, and 46.

The slots 48 in the rows of slots 46 are staggered in relation to the slots 48 in the rows of slots 45. Likewise, the slots 47 in the row of slots 42 are staggered in relation to the slots 48 in the rows of slots 46. The period of slots 47 and 48 and the shape of slots 47 and 48 determine the resonant operating frequency of the electro-magnetic radiation. The overall size of the antenna 40 determines the beamwidth of the electromagnetic radiation that is received and transmitted by the slotted waveguide antenna 40. Other configurations of the rows of slots 42, 45, and 46 are possible. The arrangement of the slots is determined by complex requirements including how much power is radiated from each area of the antenna, impedance matching, beamshape and sidelobe levels. There are well known design rules that constrain the arrangements of the slots that must be followed to make a usable antenna. The period and shapes of slots 47 and 48 are based on standard design methods known to those skilled in the art.

The microstrip patch array antenna 40 includes a ground plane 67, at least one row of microstrips represented generally by the numeral 65 and at least one dielectric layer 68. The row of microstrips 65 comprises microstrips 66 formed from a periodically patterned array of metal or conductive material that overlays the top surface 69 of the dielectric layer 68 of microstrip patch array antenna 60. The periodically patterned array of microstrips 66 includes more columns than rows. In one implementation of this embodiment, there are two rows of microstrips 65. The slots 47 in the slotted waveguide antenna 40 that are overlaid by the microstrip patch array antenna 60 are positioned parallel to the rows of microstrips 65 and on the opposite side of the ground plane 67 from the rows of microstrips 65. In one implementation of this embodiment, the row 42 is in the middle of the length of the slotted waveguide antenna 40. In another implementation of this embodiment, the dual band antenna 21 includes more than one row 42 that is overlaid by the microstrip patch array antenna 60.

In one implementation of this embodiment, the slotted waveguide antenna 40 is an X-band weather radar slotted waveguide antenna and a microstrip patch array antenna 60 is a millimeter wave microstrip patch array antenna. In this case, the slotted waveguide antenna must emit frequency at a lower frequency (typically 2-3 or more times lower in frequency) than the microstrip antenna array to maintain the relationship between patch elements and the slots. The acceptable ratios of frequency for the combined the slotted and microstrip antennas can be determined as is understandable based on the teaching of the present application and knowledge of the art.

In one implementation of this embodiment, the slotted waveguide antenna 40 end fed slotted waveguide antenna in which the waveguide structure that feeds the slotted waveguide antenna 40 runs down the edge of the slotted waveguide antenna 40.

Figure 3:
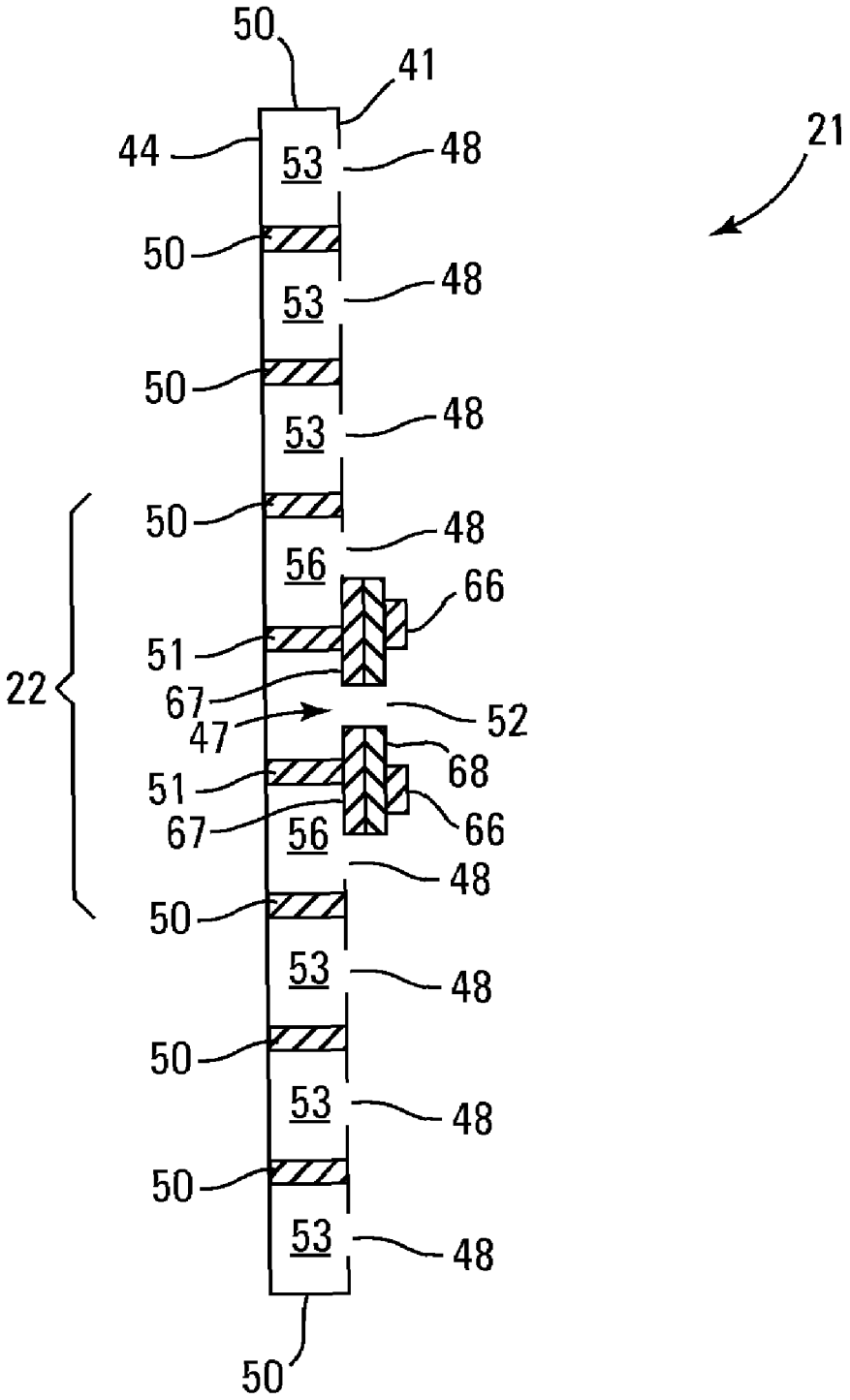
FIG. 3 shows a side cross-sectional view of one embodiment of a dual band antenna in accordance with the present invention.
Figure 4:
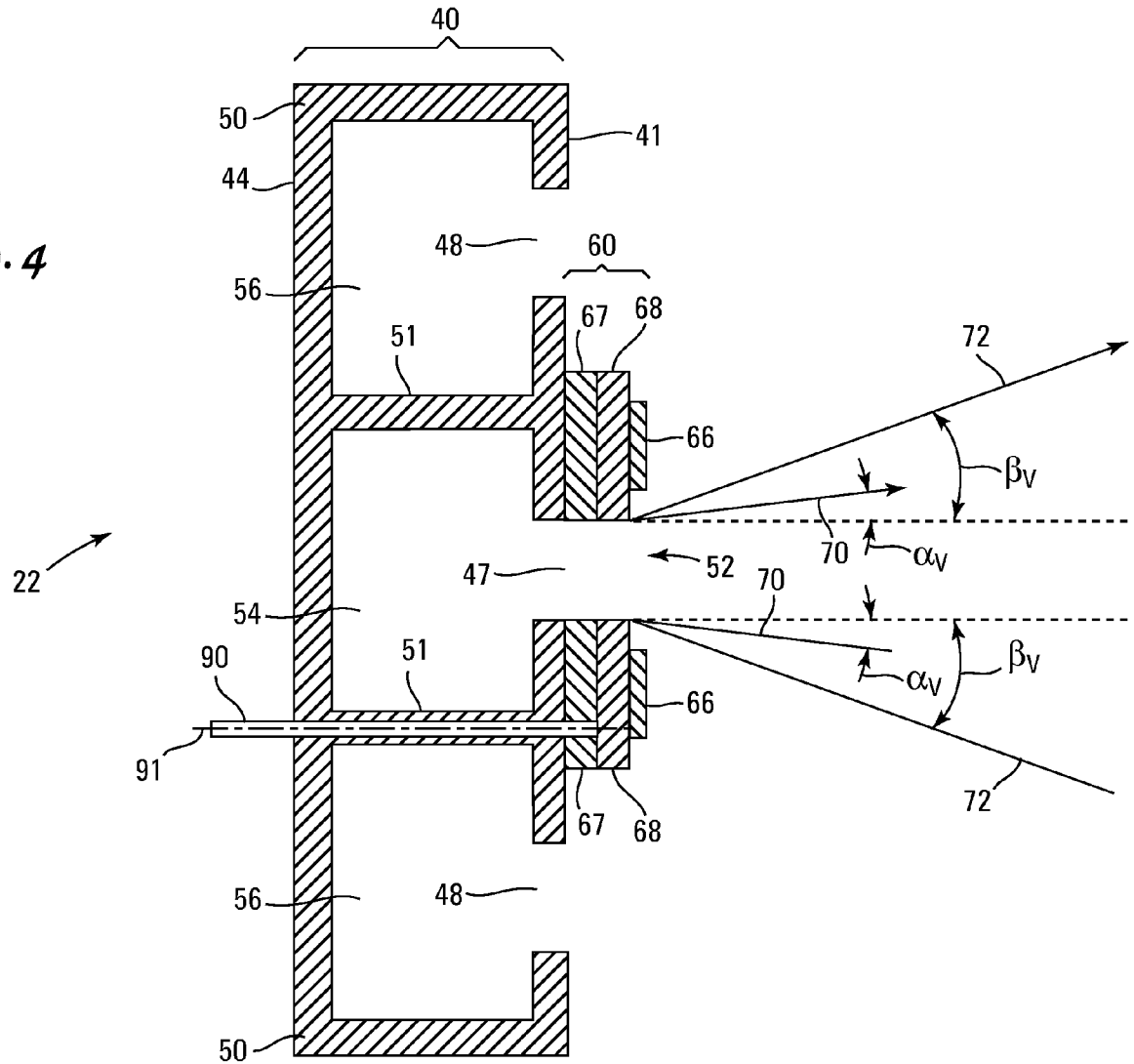
FIG. 4 shows a side cross-sectional view of one embodiment of an enlarged portion of a dual band antenna in accordance with the present invention.

FIG. 3 shows a side cross-sectional view of one embodiment of the dual band antenna 21 in accordance with the present invention. The plane upon which the cross-section view of FIG. 3 is taken is indicated by section line 3-3 in FIG. 2. FIG. 4 shows a side cross-sectional view of one embodiment of an enlarged portion 22 of the dual band antenna 21 in accordance with the present invention. The portion 22 shown in FIG. 4 is an enlarged view of the interface between the slotted waveguide antenna 40 and the microstrip patch array antenna 60.

Cavities 53 are defined by neighboring walls 50, the front surface 41, and the back surface 44. Cavity 54 is defined by neighboring walls 51, the front surface 41, and the back surface 44. Cavities 56 are defined by wall 51 that is shared with cavity 54, wall 50 shared by cavity 53, the front surface 41, and the back surface 44. The cavities 53, 54 and 56 extend the complete width W (FIG. 2) of the slotted waveguide antenna 40. The slots 48 are periodic openings in the front surface 41 of cavities 53 and 56. The slots 47 are openings in the front surface 41 of cavity 54, which underlies the microstrip patch array antenna 60. In one implementation of this embodiment, the microstrip patch array antenna 60 overlays more than one cavity 54.

The dielectric layer 68 separates the micro-strips 66 from the ground plane 67. The ground plane 67 overlays the front surface 41 of the cavity 54 the slotted waveguide antenna 40. The microstrip patch array antenna 65 is modified in regions 52 overlying the slots 47 in the subset 42 of rows of slots 42, 45 and 46 in the slotted waveguide antenna 40. Specifically, the ground plane 67 and the at least one dielectric layer 68 of microstrip patch array antenna are removed in regions 52 overlying slots 47 in the subset 42 of rows of slots 42, 45 and 46 in the slotted waveguide antenna 40 of dual band antenna 21.

A coax cable 90 (FIG. 4) is communicatively coupled to feed millimeter wave signals between the millimeter wave transceiver 85 (FIG. 2) and the microstrip patch array antenna 60. The coax cable 90 is a micro-cable that passes through at least one wall 51 of the slotted waveguide antenna 40.

Arrows 70 in FIG. 4 indicate the extent of the electromagnetic radiation that is emitted from the slotted waveguide antenna 40. The angle $\alpha_V$ is the vertical beamwidth of the slotted waveguide antenna 40. Arrows 72 in FIG. 4 indicate the extent of the electro-magnetic radiation that is emitted from the microstrip patch array antenna 60. The angle $\beta_V$ is the vertical beamwidth of the microstrip patch array antenna 60

Figure 5:
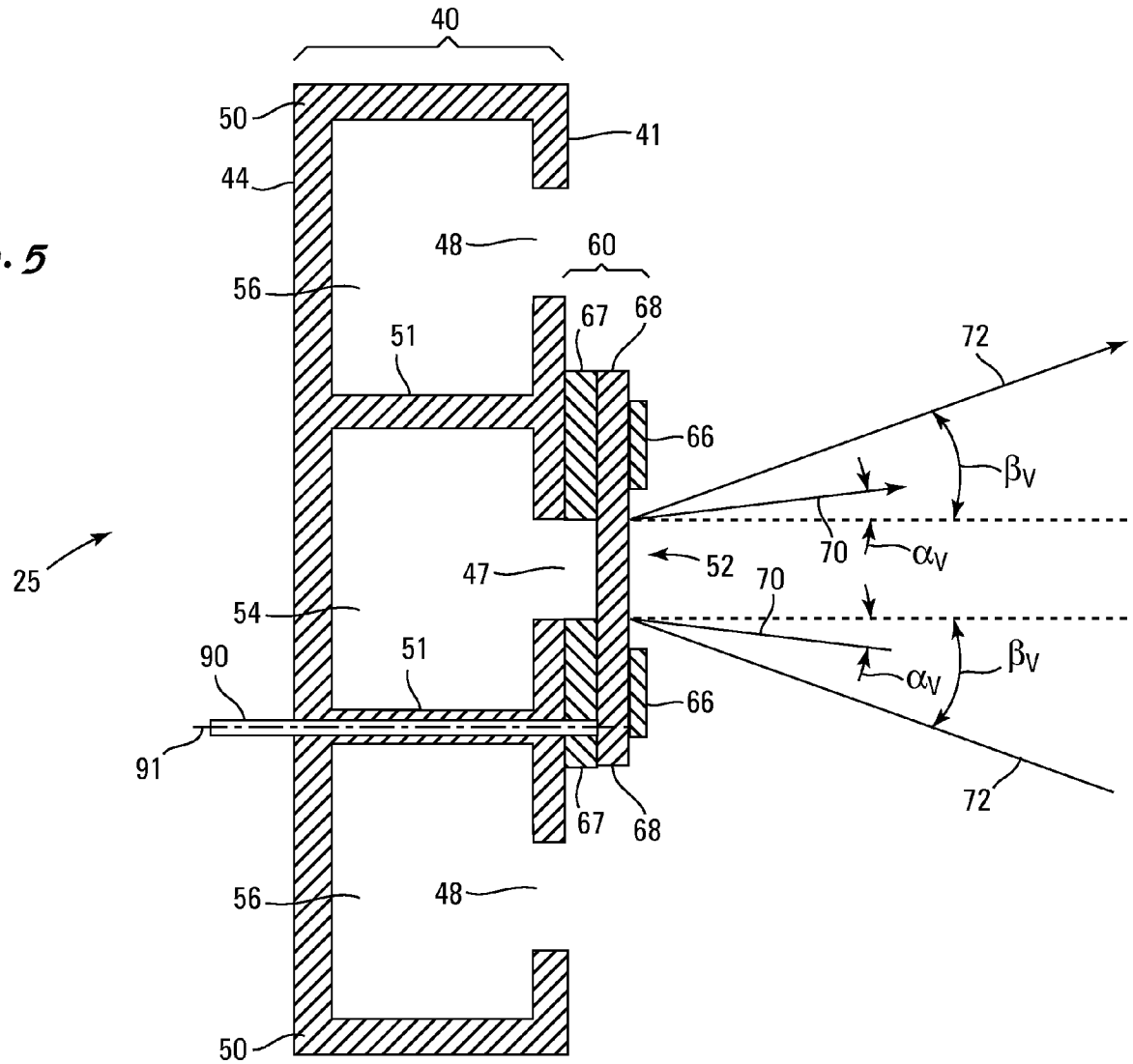
FIG. 5 shows a side cross-sectional view of one embodiment of an enlarged portion of a dual band antenna in accordance with the present invention.

FIG. 5 shows a side cross-sectional view of one embodiment of an enlarged portion 25 of a dual band antenna in accordance with the present invention. The portion 25 of FIG. 5 differs from the portion 22 of FIG. 4 in that the dielectric layer 68 is not removed from the regions 52 overlying slots 47 in the subset 42 of rows of slots 42, 45 and 46 in the slotted waveguide antenna 40. In one implementation of this embodiment, the portion of the dielectric layer 68 that is not removed from the regions 52 overlying slots 47 in the slotted waveguide antenna 40 is used to tune the dual band antenna 21. The microstrip patch array antenna 60 is modified by only removing the ground plane 67 in the regions 52 overlying slots 47 in the subset 42 of rows of slots 42, 45 and 46 in the slotted waveguide antenna 40. The electro-magnetic radiation is able to radiate through the dielectric layer 68. The dual band antenna 21 (FIG. 2) includes either portion 22 of FIG. 4 or portion 25 of FIG. 5.

Figure 6:
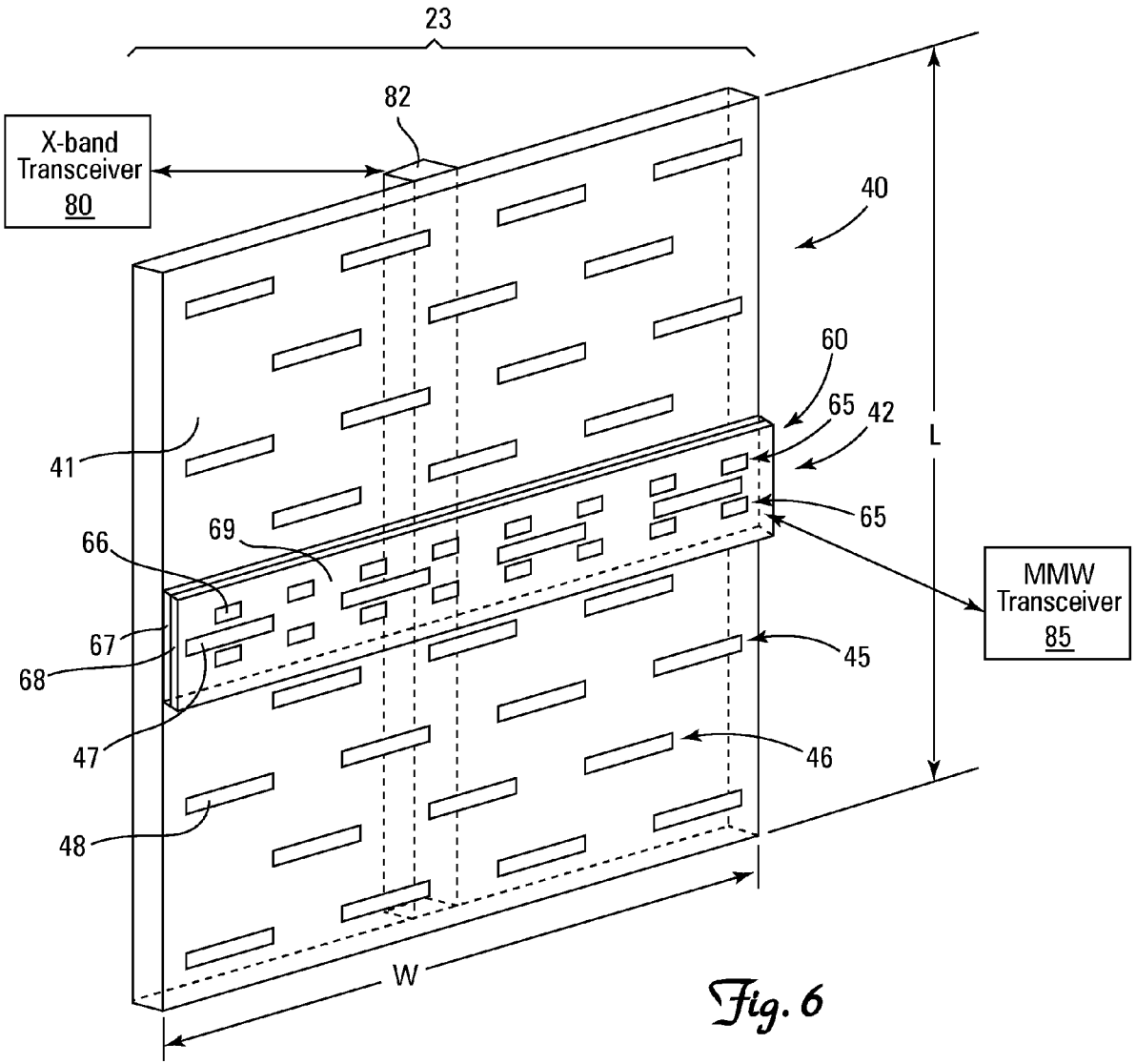
FIG. 6 shows an oblique view of one embodiment of a dual band antenna and communicatively coupled transceivers in accordance with the present invention.

FIG. 6 shows an oblique view of one embodiment of a dual band antenna 23 and communicatively coupled transceivers 80 and 85 in accordance with the present invention. The dual band antenna 23 includes the dual band antenna 21 (FIG. 2) and a slotted waveguide feedline 82 (referred to herein as "X-band feedline 82" or "vertical waveguide feedline 82"), which is viewed through the slotted waveguide antenna 40. The vertical waveguide feedline 82 has a centrally located waveguide connector. It may be adapted to standard coax by means of a coax to waveguide adapter. The transceiver for the dual band antenna 23 includes a millimeter wave transceiver 85 and an X-band transceiver 80.

Figure 10:
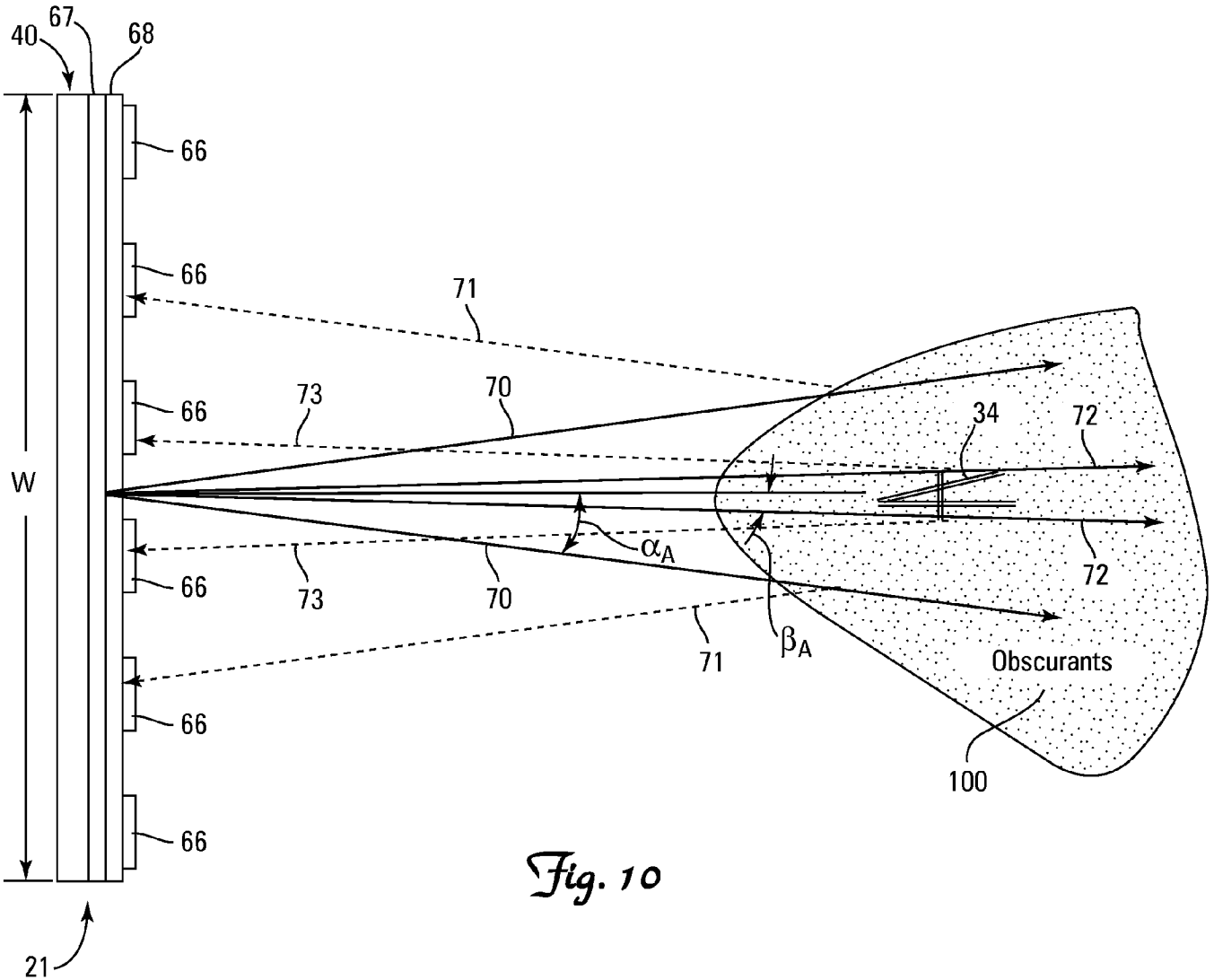
FIG. 10 shows a plan view of one embodiment of the dual band antenna emitting and receiving electro-magnetic radiation in accordance with the present invention.

The millimeter wave transceiver 85 is communicatively coupled to the microstrip patch array antenna 60. The coax cable 90 shown in FIG. 5 is used to communicatively couple millimeter wave signals between the millimeter wave transceiver 85 and the microstrip patch array antenna 60. In response to the receiving the coupled signals, the slotted waveguide antenna 60 emits radio frequency radiation at a first frequency. The radio frequency radiation emitted from the microstrip patch array antenna 40 has a vertical beamwidth $\beta_V$ (FIGS. 4 and 5) and a horizontal or azimuthal beamwidth $\beta_A$ (as shown in FIG. 10 below). In one implementation of this embodiment, the millimeter wave transceiver 85 is fixed to a portion of the back surface 44 of the slotted waveguide antenna 40.

The X-band feedline 82 is attached to at least a portion of a back surface 44 (FIG. 1) of the slotted waveguide antenna 40. The X-band feedline 82 is perpendicular to the rows of slots 42, 45, and 46 and extends the length L of the dual band antenna 23. The X-band transceiver 80 and the X-band feedline 82 are communicatively coupled to feed signals between the X-band transceiver 80 and the slotted waveguide antenna 40. The signals generated by the X-band transceiver 80 are fed into the X-band feedline 82 and the first order mode of the signals propagating along the X-band feedline 82 is coupled into the slotted waveguide antenna 40. The slotted waveguide feedline 82 is designed to support a fundamental mode that couples to the slotted waveguide antenna 40. In one implementation of this embodiment, the X-band transceiver 80 is fixed to a portion of a back surface 44 of the slotted waveguide antenna 40 near or adjacent to the X-band feedline 82.

In response to the coupling of the fundamental mode, the slotted waveguide antenna 40 emits radio frequency radiation at a second frequency, which is less than the first frequency emitted by the microstrip patch array antenna 60. The radio frequency radiation emitted from the slotted waveguide antenna 40 has a vertical beamwidth $\alpha_V$ (FIGS. 4 and 5) and a horizontal or azimuthal beamwidth $\alpha_A$ (as shown in FIG. 10 below).

In one implementation of this embodiment, the slotted waveguide feedline 82 is designed to support the fundamental mode and at least one higher order mode that couple to the slotted waveguide antenna 40 and the microstrip patch array antenna 60, respectively. In this case, the higher order mode propagating along slotted waveguide feedline 82 couples millimeter wave signals to the microstrip patch array antenna 60 while the slotted waveguide feedline 82 simultaneously couples the fundamental mode to feed X-band signals to the slotted waveguide antenna 40. In this case, a waveguide transducer (not shown) is coupled to both the millimeter wave transceiver 85 and an X-band transceiver 80. The waveguide transducer then is used to feed the output from the each of the millimeter wave transceiver 85 and the X-band transceiver 80 to the slotted waveguide feedline 82. In this manner, the X-band transceiver 80 couples to the low order mode and the millimeter wave transceiver 85 couples to the high order mode.

The interface between the slotted waveguide antenna 40 and the microstrip patch array antenna 60 in dual band antenna 23 can be as shown in FIG. 4 or FIG. 5. In one implementation of this embodiment, the dielectric layer 68 that is not removed from the regions 52 overlying slots 47 in the slotted waveguide antenna 40 is used to tune the dual band antenna 23 as is understandable based on FIG. 5.

Figure 7:
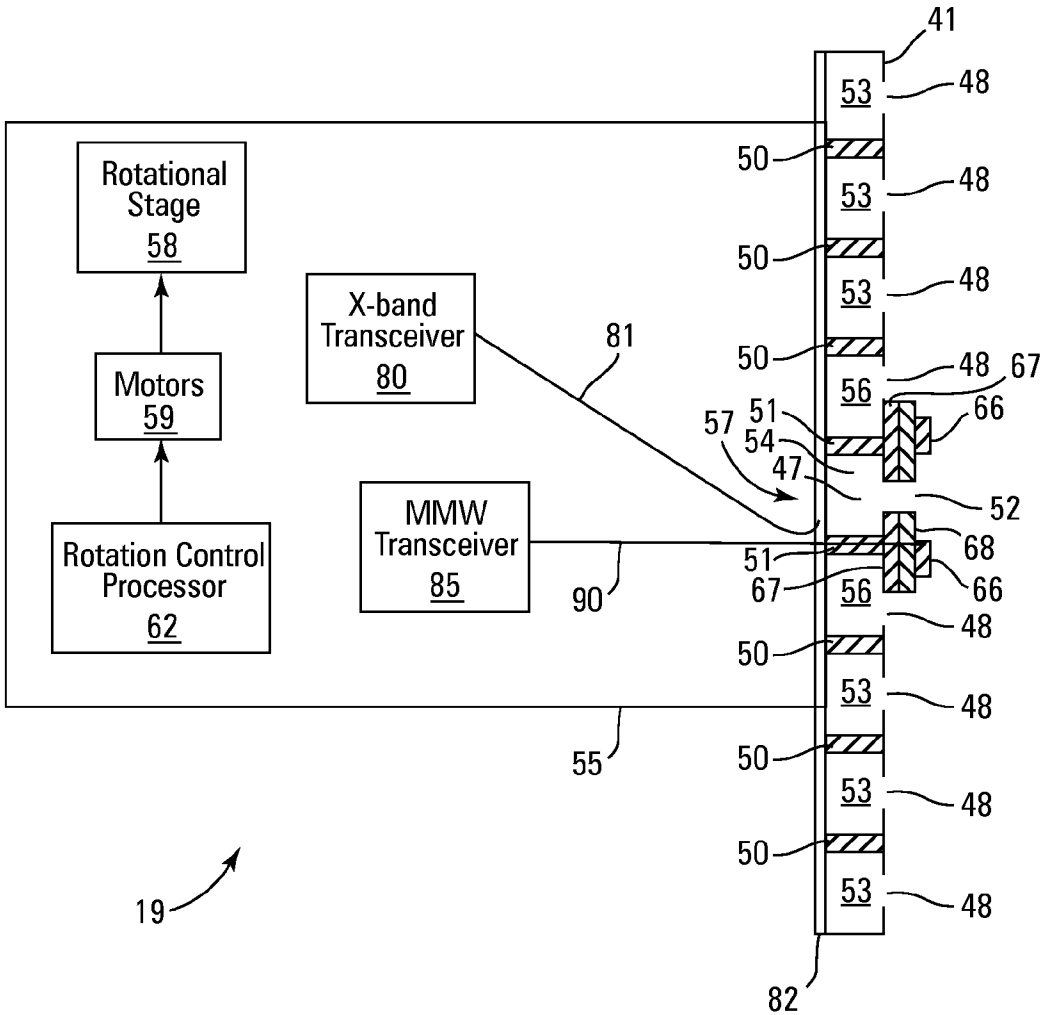
FIG. 7 is a block diagram of one embodiment of a dual band antenna that is rotatable in accordance with the present invention.

FIG. 7 is a block diagram of one embodiment of a dual band antenna 23 (FIG. 6) that is rotatable in accordance with the present invention. At least one rotational stage 58, such as an azimuth gimbal mount, is attached to at least a portion of the back surface 44 of the slotted waveguide antenna 40 to rotate the antennae. A pedestal 55 (fixed within the radome 17) is operably positioned with respect to motors 59 and at least one rotational stage 58 so that the motors 59 cause the dual band antenna 23 to rotate within the radome 17 (FIG. 1) when rotational instructions are received from one or more rotation control processors 62 that control the amount and direction of rotation of the dual band antenna 23. In this manner the dual band antenna 23 (or dual band antenna 21) housed in the radome 17 is rotated and the emitted radiation, such as first and second radio frequency signals, is scanned.

The transceiver for the system 19 as shown in FIG. 7 includes a millimeter wave transceiver 85 and an X-band transceiver 80. The coax cable 90 communicatively couples millimeter wave signals between the microstrip patch array antenna 60 and the millimeter wave transceiver 85 located on the back surface 44 of the slotted waveguide antenna 40. In this manner, the coax cable 90 feeds the microstrip patch array antenna 60.

Signals are fed from the X-band transceiver 80 to the center of the X-band feedline 82 via a waveguide connector represented generally by the line 81, which may be operably attached to a coax by a coax-to-waveguide adaptor (not shown). The X-band feedline 82 and the waveguide connector 81 are operably attached to each other to communicatively couple signals between the X-band transceiver 80 and the slotted waveguide antenna 40. In this manner, the waveguide connector 81 and the waveguide feedline 82 feed the slotted waveguide antenna 40.

The transceivers 80 and 85 may be mounted in pedestal 55 but are more advantageously mounted on the back of the overall dual band antenna 23 (or dual band antenna 21). If the transceivers 80 and 85 are located in the pedestal 55, the waveguide connector 81 and the coax 90 extend through an open region represented generally by the numeral 57 of the attached rotational stages 58 to connect the respective transceivers 80 and 85 to the respective slotted waveguide antenna 40 and microstrip patch array antenna 60. In this case, the coax cable 90 and the waveguide connector 81 are positioned to carry the feed signals regardless of the angle of the rotational stages 58.

At least a portion of the back surface 44 of the dual band antenna 23 is attached to the at least one rotational stage 58. The dual band antenna 23 is scanned as the rotational stage 58 rotates and the radiation emitted from the dual band antenna 23 is scanned while the dual band antenna 23 rotates.

Figure 8:
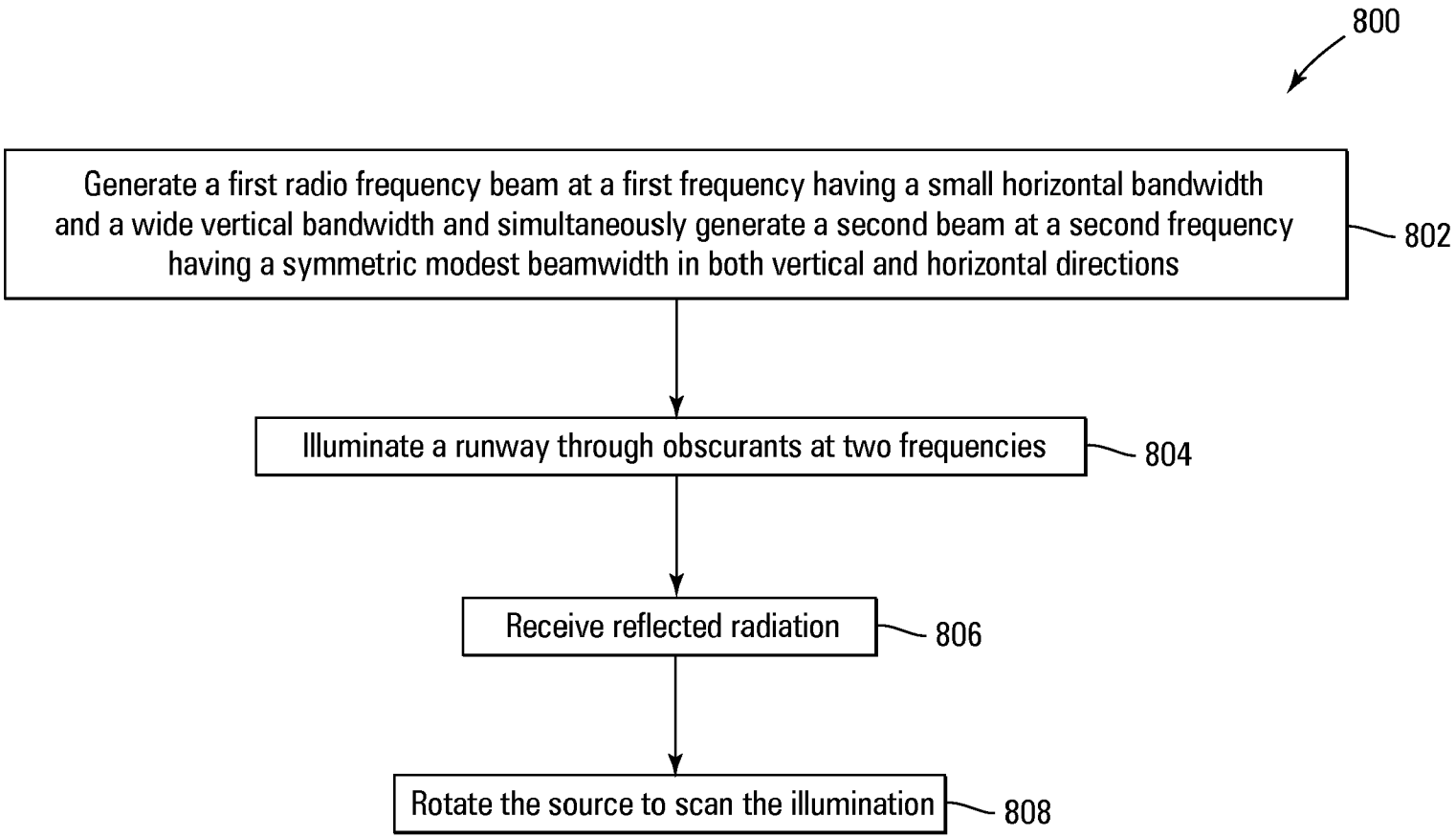
FIG. 8 is a flow diagram of one embodiment of a method to provide broadband synthetic vision in accordance with the present invention
Figure 9:
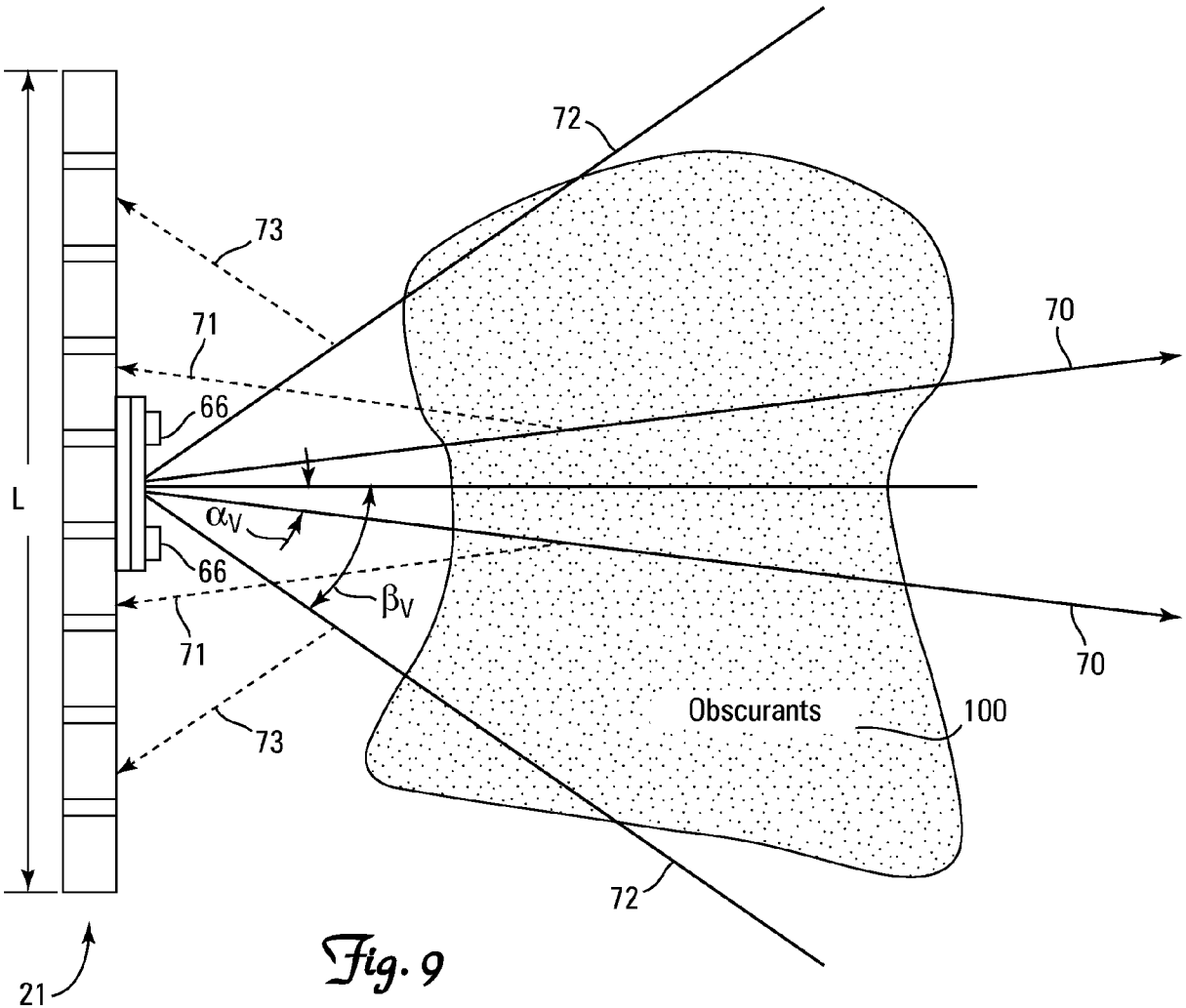
FIG. 9 shows an elevation view of one embodiment of a dual band antenna emitting and receiving electro-magnetic radiation in accordance with the present invention.

FIG. 8 is a flow diagram of one embodiment of a method 800 to provide broadband synthetic vision in accordance with the present invention. The method 800 is described with reference to the dual band antenna 21 as shown in FIGS. 2, 9 and 10. FIG. 9 shows a side view of one embodiment of a dual band antenna 21 emitting and receiving electro-magnetic radiation in accordance with the present invention. FIG. 10 shows a top view of one embodiment of a dual band antenna 21 emitting and receiving electro-magnetic radiation in accordance with the present invention. At least one processor, such as processor 32 (FIG. 1), is used to process the signals generated at the dual band antenna system 20 as is known in the art.

At block 802, the microstrip patch array antenna in the source generates a first radio frequency beam at a first frequency that is emitted from the source with a small horizontal beamwidth $\beta_A$ (FIG. 10) and a large vertical beamwidth $\beta_V$ (FIG. 9) and the slotted waveguide antenna in the source simultaneously generates a second beam at a second frequency that is emitted from the source with a moderate horizontal beamwidth $\alpha_A$ (FIG. 10) and an equal moderate vertical beamwidth $\alpha_V$ (FIG. 9). The vertical X-band beam is narrower than the vertical millimeter beam. The first radio frequency beam at the first frequency and the second radio frequency beam at the second frequency propagate through the obscurants 100.

The horizontal beamwidth $\beta_A$ of the first radio frequency beam is also referred to herein as the "azimuthal beamwidth $\beta_A$." Arrows 72 in FIGS. 9 and 10 indicate the extent of the electro-magnetic radiation in the first radio frequency beam at the first frequency that is emitted from the source. The first radio frequency beam is emitted from the microstrip patch array antenna in the source. In one implementation of this embodiment, the first radio frequency beam is emitted from the microstrip patch array antenna 60 of the dual band antenna 21. In another implementation of this embodiment, the first radio frequency beam is emitted from the microstrip patch array antenna 60 of the dual band antenna 23.

The horizontal beamwidth $\alpha_A$ of the second radio frequency beam is also referred to herein as the "azimuthal beamwidth $\alpha_A$." Arrows 70 in FIGS. 9 and 10 indicate the extent of the electro-magnetic radiation in the second radio frequency beam at the second frequency that is emitted from the source. The second radio frequency beam is emitted from the slotted waveguide antenna in the source. In one implementation of this embodiment, the second radio frequency beam is emitted from the slotted waveguide antenna 40 of the dual band antenna 21. In another implementation of this embodiment, the second radio frequency beam is emitted from the slotted waveguide antenna 40 of the dual band antenna 23.

In one implementation of this embodiment, the radome 17 (FIG. 1), which houses the dual band antenna 21 or 23 is designed to transmit a first frequency that is an integral multiple of the second frequency, when the radome 17 is designed to be transparent at the second frequency. For example, if the radome 17 is tuned to be transparent at the second frequency of 9.3 GHz, then first frequency is 27.9 GHz, which is equal to three times 9.3 GHz. In this manner, the radome 17 is also transparent to the first frequency of 27.9 GHz. Thus, the millimeter wave signal does not reflect within the radome 17 and the first radio frequency beam and the second radio frequency beam emitted from the dual band antenna 21 or 23 do not interfere with each other.

The first frequency is greater than the second frequency. In one implementation of this embodiment, the first frequency is 35 GHz and the second frequency is 10 GHz. In another implementation of this embodiment, the first frequency is greater than 20 GHz and the second frequency is in the range from about 8 GHz to about 12 GHz. In another implementation of this embodiment, the first frequency is in the range from about 20 GHz to about 35 GHz and the second frequency is in the range from about 8 GHz to about 18 GHz.

The overall width of each antenna determines its horizontal beamwidth and the overall height of each antenna determines the vertical beamwidth. Specifically, the beamwidth of the emitted radiation is inversely proportional to the antenna dimension. Thus, in the illustrated dual band antenna 21 (FIGS. 2 and 3), since the vertical dimension of the illustrated microstrip patch array antenna 60 is small (only two rows), the vertical beamwidth $\beta_V$ is large. The horizontal width of the microstrip patch array antenna 60 is many columns and therefore the horizontal beamwidth $\beta_A$ is narrow. The slotted waveguide antenna 40 is of equal dimensions in width and height and therefore has a beamwidth that is of equal dimensions vertically and horizontally, e.g., beamwidth $\alpha_A$ is about equal to beamwidth $\alpha_V$. The entire collection of the patches and slots in aggregate produce a beamshape.

The operating frequency of antenna determines the actual beamwidth according to the dimensions of the aperture. For example, the width of the slotted and microstrip patch array antenna 60 are equal dimensions and if they operated at the same frequency they would have the same horizontal beamwidth, e.g., $\alpha_A$ would be about equal to $\beta_A$. But as frequency increases for a given dimension, the beamwidth narrows. So if the microstrip patch array antenna 60 operates at a frequency that is three times that of the microwave slotted antenna, the horizontal beamwidth of the microstrip patch array antenna 60 is three times narrower than the microwave slotted antenna even though the two have exactly the same horizontal dimension. In the vertical dimension, the microstrip patch array antenna 60 is a fraction (much less than ⅓) of the height (length) of the microwave slotted antenna and so the microstrip patch array antenna 60 has a vertical beamwidth that is greater than the vertical beamwidth of the microwave antenna. This is important because, as is shown in FIG. 9, it would not be possible to illuminate the length of the runway with a narrow beam having an extent indicated by arrows 70. In this case, the runway would appear in profile with buildings along the runway extending vertically in the diagram and the runway laid out left to right. The narrow microwave beam (having the extent 72 as shown in FIG. 10) illuminates a small fraction of the runway length and the wide vertical beamwidth of the millimeter wave (having the extent 70 as shown in FIG. 10) illuminates the entire length.

At block 804, a runway, such as runway 34 in FIG. 1, is illuminated through obscurants at two frequencies, the first frequency and the second frequency. In one implementation of this embodiment, an object other than a runway is illuminated through obscurants at the two frequencies.

At block 806, the dual band antenna 23 receives reflected radiation. The microstrip patch array antenna in the source receives first reflected radiation reflected from the runway. The slotted waveguide antenna of the source receives second reflected radiation that is reflected from the atmosphere above the runway.

The first reflected radiation is based on the illuminating at the first frequency and includes information indicative of an image of the runway. The first reflected radiation is the radiation at the first frequency that is reflected and/or scattered off the runway and the atmosphere above the runway back toward the microstrip patch array antenna. Arrows 73 indicate the first reflected radiation in FIGS. 9 and 10. In an exemplary case, the microstrip patch array antenna 60 of the source 21 in the dual band antenna system 20 receives the first reflected radiation reflected from the runway 34. The microstrip patch array antenna 60 sends signals to the millimeter wave transceiver 85 (FIG. 2) which sends signals including the information indicative of runway 34 to the processor 32 in the display 30 (FIG. 1). Processor 34 processes the information indicative of an image of the runway 34 and generates an image of the runway that is displayed on the screen 33 of the display 30. The displayed image of the runway 34 assists a pilot of an aircraft 15 during takeoff and landing.

The second reflected radiation based on the illumination at the second frequency and includes information indicative of wind shear. The second reflected radiation is the radiation at the second frequency that is reflected and/or scattered off the runway and the atmosphere above the runway back toward the slotted waveguide antenna. Arrows 71 indicate the second reflected radiation in FIGS. 9 and 10. In an exemplary case, the slotted waveguide antenna 40 of the source 21 in the dual band antenna system 20 receives the second reflected radiation that is reflected from the atmosphere above the runway 34. The slotted waveguide antenna 40 sends signals to the X-band transceiver 80 (FIG. 2) which sends signals including the information indicative of windshear above the runway 34 to the processor 32 in the display 30 (FIG. 1). The windshear is detected when the second radio frequency is Doppler shifted from a column of air and water that hits the ground and spreads out. The Doppler shift from such an event is a signature for windshear as is known in the art. Processor 34 processes the information indicative of an image of the runway 34 and generates an image of the windshear above the runway that is displayed on the screen 33. In one implementation of this embodiment, the processor 34 generates a warning that the atmosphere above or to the sides of the runway 34 are experiencing wind turbulence that is or may become windshear. If the pilot of the aircraft 15 is notified of a potential or actual windshear, the pilot takes steps to avoid flying into the area that is experiencing or about to experience windshear.

At block 808, the source (antenna) is rotated to scan the illumination. In one implementation of this embodiment, the source 21 or source 23 is attached to the rotational stages 58, which rotate the source 21 or 23 within the radome 17. The view of the atmosphere above to the sides of the runway is imaged due to the scanning of the illumination. Any objects above or to the sides of the runway are also imaged due to the scanning of the illumination. Since the source 21 or 23 are emitting the first and second radio frequency beam from the same region, the scanning of the source 21 or 23 provides a scanning of both the first and second radio frequency beams simultaneously by the same rotational stage 58 affixed to a pedestal 55. The weight of the microstrip patch array antenna 60 overlaying the slotted waveguide antenna 40 is insignificant compared to the weight of a second pedestal to hold a second rotational stage in order to scan a separately located microstrip patch array antenna. The space occupied by the microstrip patch array antenna 60 overlaying the slotted waveguide antenna 40 is insignificant compared to the space occupied by a second pedestal to hold a second rotational stage in order to scan a separately located microstrip patch array antenna.

In this manner, embodiments of the dual band antenna system 20 provide ways to simultaneously generate a first radio frequency beam having a first radio frequency beam at a first frequency having a first beamwidth characteristic and a second beam at a second frequency having a second beamwidth characteristic and to radiate the generated first and second radio frequency signals. Embodiments of dual band antenna system 20 provide ways to feed a slotted waveguide antenna and ways to feed a microstrip patch array antenna. In another implementation of this embodiment, the dual band antenna system 20 provides a way to feed a slotted waveguide antenna and a microstrip patch array antenna with one feedline. Dual band antenna system 20 also provides way to house the source, such as source 21 or 23, and to rotate the source within the housing to simultaneously generate and scan the first radio frequency beam at the first frequency having the first beamwidth characteristic and the second beam at the second frequency having the second beamwidth characteristic. The dual band antenna system 20 also receives the first reflected radiation from the scattering and reflecting of the first radio frequency beam. The dual band antenna system 20 simultaneously receives the second reflected radiation from the scattering and reflecting of the second radio frequency beam.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed is:

1. A dual band antenna system for synthetic vision systems, the system comprising:

a slotted waveguide antenna having rows of slots on a front surface, the slotted waveguide antenna fed by a single slotted waveguide feedline and operable to generate a second radio frequency beam at a second frequency;

a microstrip patch array antenna overlying a subset of the rows of slots of the slotted waveguide antenna, the microstrip patch antenna operable to generate a first radio frequency beam at a first frequency, wherein the first frequency differs from the second frequency; and at least one transceiver communicatively coupled to at least one of the slotted waveguide antenna and the microstrip patch array antenna.

2. The system of claim 1, wherein the microstrip patch array antenna comprises:

a ground plane overlying the front surface of the slotted waveguide antenna;

at least one row of microstrips; and at least one dielectric layer separating the micro-strips and the ground plane, wherein the at least one row of microstrips is positioned parallel to the rows of slots of the slotted waveguide antenna, wherein the microstrip patch array antenna is modified in regions overlying slots in a subset of rows of slots in the slotted waveguide antenna.

3. The system of claim 2, wherein the microstrip patch array antenna is modified by removing the ground plane in regions overlying slots in the subset of rows of slots in the slotted waveguide antenna.

4. The system of claim 2, wherein the microstrip patch array antenna is modified by removing the ground plane and the at least one dielectric layer in regions overlying slots in the subset of rows of slots in the slotted waveguide antenna.

5. The system of claim 1, wherein the at least one transceiver comprises a millimeter wave transceiver, the system further comprising:

a coax cable communicatively coupled to feed millimeter wave signals between the millimeter wave transceiver and the microstrip patch array antenna.

6. The system of claim 5, wherein the coax cable is a micro-cable that passes through at least one wall of the slotted waveguide antenna.

7. The system of claim 5, wherein the at least one transceiver further comprises an X-band transceiver, and wherein the single slotted waveguide feedline is an X-band feedline, the system further comprising:

the X-band feedline communicatively coupled to feed signals between the X-band transceiver and the slotted waveguide antenna.

8. The system of claim 1, wherein the at least one transceiver comprises a millimeter wave transceiver and an X-band transceiver, the system further comprising:

the slotted waveguide feedline attached to at least a portion of a back surface of the slotted waveguide antenna, wherein the slotted waveguide feedline communicatively couples a fundamental mode to feed X-band signals to and from the slotted waveguide antenna and wherein the slotted waveguide feedline communicatively couples higher order modes to feed millimeter wave signals to and from the microstrip patch array antenna.

9. The system of claim 1, wherein the slotted waveguide antenna is an X-band weather radar slotted waveguide antenna.

10. The system of claim 1, wherein the microstrip patch array antenna is a millimeter wave microstrip patch array antenna.

11. The system of claim 1, further comprising:

at least one rotational stage attached to at least a portion of a back surface of the slotted waveguide antenna to rotate the antennae.

12. The system of claim 11, wherein the at least one transceiver comprises a millimeter wave transceiver and an X-band transceiver, wherein the slotted waveguide feedline is a vertical waveguide feedline, the system further comprising:

a coax cable to communicatively couple millimeter wave signals between the millimeter wave transceiver and the microstrip patch array antenna; and the vertical waveguide feedline to communicatively couple signals between the X-band transceiver and the slotted waveguide antenna.

13. The system of claim 11, wherein the at least one transceiver comprises a millimeter wave transceiver and an X-band transceiver, the system further comprising:

the slotted waveguide feedline, wherein the slotted waveguide feedline communicatively couples a fundamental mode to feed X-band signals to and from the slotted waveguide antenna and wherein the slotted waveguide feedline communicatively couples higher order modes to feed millimeter wave signals to and from the microstrip patch array antenna, wherein the X-band transceiver and the millimeter wave transceiver are located on a back surface of the slotted waveguide antenna.

14. A method to provide broad-band synthetic vision, the method comprising:

generating a first radio frequency beam at a first frequency having a small horizontal beamwidth and a large vertical beamwidth, wherein the first radio frequency beam is emitted from a source; and simultaneously generating a second radio frequency beam at a second frequency having an equal moderate horizontal beamwidth and vertical beamwidth, wherein the second radio frequency beam is emitted from the source.

15. The method of claim 14, further comprising;

illuminating a runway through obscurants at the first frequency;

receiving first reflected radiation reflected from the runway, the first reflected radiation based on the illuminating at the first frequency and the first reflected radiation including information indicative of an image of the runway;

illuminating the runway through the obscurants at the second frequency; and receiving second reflected radiation from the atmosphere above the runway, the second reflected radiation based on the illuminating at the second frequency and the second reflected radiation including information indicative of wind shear.

16. The method of claim 14, further comprising:

rotating the source to scan the illumination.

17. A dual band antenna system for synthetic vision systems, the system comprising:

means for simultaneously generating a first radio frequency beam at a first frequency having a first beamwidth characteristic in which a horizontal beamwidth differs from a vertical beamwidth, and a second beam at a second frequency having a second beamwidth characteristic in which a horizontal beamwidth is substantially the same as vertical beamwidth; and means, responsive to the means for generating, for radiating the first and second radio frequency signals.

18. The system of claim 17, wherein the means for radiating comprises:

means for feeding a slotted waveguide antenna; and means for feeding a microstrip patch array antenna.

19. The system of claim 17, wherein the means for radiating comprises:

means for feeding a slotted waveguide antenna and a microstrip patch array antenna.

20. The system of claim 17, the system further comprising:

means for housing the means for generating; and means for rotating the means for simultaneously generating within the means for housing.

* * * * *